US007900718B2

(12) United States Patent
Lyons

(10) Patent No.: US 7,900,718 B2
(45) Date of Patent: Mar. 8, 2011

(54) EARTH-BORING TOOLS HAVING THREADS FOR AFFIXING A BODY AND SHANK TOGETHER AND METHODS OF MANUFACTURE AND USE OF SAME

(75) Inventor: Nicholas J. Lyons, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 196 days.

(21) Appl. No.: 12/266,282

(22) Filed: Nov. 6, 2008

(65) Prior Publication Data

US 2010/0108397 A1 May 6, 2010

(51) Int. Cl.
*E21B 17/04* (2006.01)

(52) U.S. Cl. ..... 175/320; 175/331

(58) Field of Classification Search ..... 175/320, 175/327, 331

See application file for complete search history.

(56) References Cited

U.S. PATENT DOCUMENTS

| | | | | |
|---|---|---|---|---|
| 866,361 | A | | 9/1907 | Hitchcock |
| 1,791,186 | A | | 2/1931 | Black |
| 2,051,525 | A | | 8/1936 | Howard |
| 2,065,743 | A | * | 12/1936 | Reed ..... 175/366 |
| 4,567,954 | A | * | 2/1986 | Voight et al. ..... 175/424 |
| 5,441,121 | A | | 8/1995 | Tibbitts |
| 5,765,095 | A | | 6/1998 | Flak et al. |
| 6,454,030 | B1 | | 9/2002 | Findley et al. |
| 2007/0102198 | A1 | | 5/2007 | Oxford et al. |
| 2007/0102199 | A1 | | 5/2007 | Smith et al. |
| 2008/0099243 | A1 | | 5/2008 | Hall et al. |
| 2008/0149393 | A1 | | 6/2008 | McClain et al. |
| 2008/0236899 | A1 | | 10/2008 | Oxford et al. |

OTHER PUBLICATIONS

International Search Report for International Application No. PCT/US2009/063088 mailed May 31, 2010, 4 pages.

International Written Opinion for International Application No. PCT/US2009/063088 mailed May 31, 2010, 3 pages.

* cited by examiner

*Primary Examiner* — William P Neuder
(74) *Attorney, Agent, or Firm* — TraskBritt

(57) ABSTRACT

Earth-boring tools comprise a shank comprising a distal connector including a set of threads thereon and a bit body comprising a shank connector, also comprising at least one set of threads thereon. The set of threads on the distal connector and the at least one set of threads on the shank connector are at least substantially bound together. Methods of forming such earth-boring tools are also disclosed, as well as methods of securing a bit body of an earth-boring tool to a shank.

43 Claims, 3 Drawing Sheets

EARTH-BORING TOOLS HAVING THREADS FOR AFFIXING A BODY AND SHANK TOGETHER AND METHODS OF MANUFACTURE AND USE OF SAME

TECHNICAL FIELD

Embodiments of the invention relate generally to earth-boring tools and methods of forming and using earth-boring tools. More particularly, embodiments of the present invention relate to earth-boring tools having features for effecting the attachment of a body to a shank and to methods of forming such tools.

BACKGROUND

Rotary drill bits are commonly used for drilling bore holes or wells in earth formations. One type of rotary drill bit is the fixed-cutter bit (often referred to as a "drag" bit), which typically includes a plurality of cutting elements secured to a face region of a bit body. The drill bit is attached to a drill string including tubular pipe and component segments coupled end-to-end between the drill bit and other drilling equipment at the surface. Equipment such as a rotary table or top drive may be used for rotating the drill string and the drill bit within the bore hole. Alternatively, the drill bit may be coupled to the drive shaft of a down-hole motor, which then may be used to rotate the drill bit, alone or in combination with rotation of the drill string from the surface.

In order to attach the drill bit to the drill string, the bit body of a conventional rotary drill bit typically is secured to a hardened steel shank having an American Petroleum Institute (API) thread connection for attaching the shank to the drill string. The bit body is typically secured to the shank by coupling the bit body and shank together and then securing the bit body to the shank. Many conventional drill bits comprise a bit body or bit crown having threads on a proximal connector portion. The threads are configured for aligning the longitudinal axis of the bit crown to the longitudinal axis of the shank. The shank and bit crown are then mechanically secured together. In some conventional drill bits, such as U.S. Publication No. 2007/0102198 to Oxford et al., the shank and bit body are mechanically secured together by welding the two pieces at a point of intersection to prevent detachment or unthreading during use.

For at least some materials used for conventional bit bodies, the use of a weld for affixing the bit body and the shank together may be detrimental to the material's performance. For example, a bit body may be formed from a material including a carbide material. Welding a carbide material to a steel shank commonly leads to a significantly weakened carbide base material, and may, in some cases, also weaken the material substantially so that cracks may form in the bit body through the heat affected zone of the carbide material.

BRIEF SUMMARY

Various embodiments of the present invention comprise earth-boring tools comprising a shank and a bit body configured to be secured together with at least one threaded connection. In one or more embodiments, the earth-boring tool may comprise a shank comprising a proximal connector at one longitudinal end and a distal connector at an opposing longitudinal end. The distal connector may comprise at least one set of threads thereon. A bit body may be coupled to the shank and may comprise a face at one longitudinal end thereof and a shank connector at an opposing longitudinal end. The shank connector may comprise threads configured to mate with the set of threads on the distal connector. The set of threads on the distal connector and the threads on the shank connector may be at least substantially bound together.

Other embodiments comprise methods for forming an earth-boring tool. One or more embodiments of such methods may comprise forming a shank comprising a distal connector including a set of threads thereon. A bit body may also be formed comprising a shank connector with threads thereon. At least a portion of the threads on the shank connector may be configured to at least partially bind with the set of threads on the distal connector. The distal connector of the shank and the shank connector of the bit body may be screwed together to secure the shank to the bit body.

Further embodiments of the invention comprise a method of securing an earth-boring tool to a shank. One or more embodiments of such methods may consist of providing a bit body comprising a shank connector at a trailing end thereof. The shank connector is formed to include threads formed thereon. A shank is provided and configured to attach to a drill string. The shank may comprise a distal connector at a leading end thereof, the distal connector comprising a set of threads thereon. The shank connector of the bit body and the distal connector of the shank may then be screwed together.

DETAILED DESCRIPTION

The illustrations presented herein are, in some instances, not actual views of any particular drill bit or threads, but are merely idealized representations which are employed to describe the present invention. Additionally, elements common between figures may retain the same numerical designation.

Figure 1:
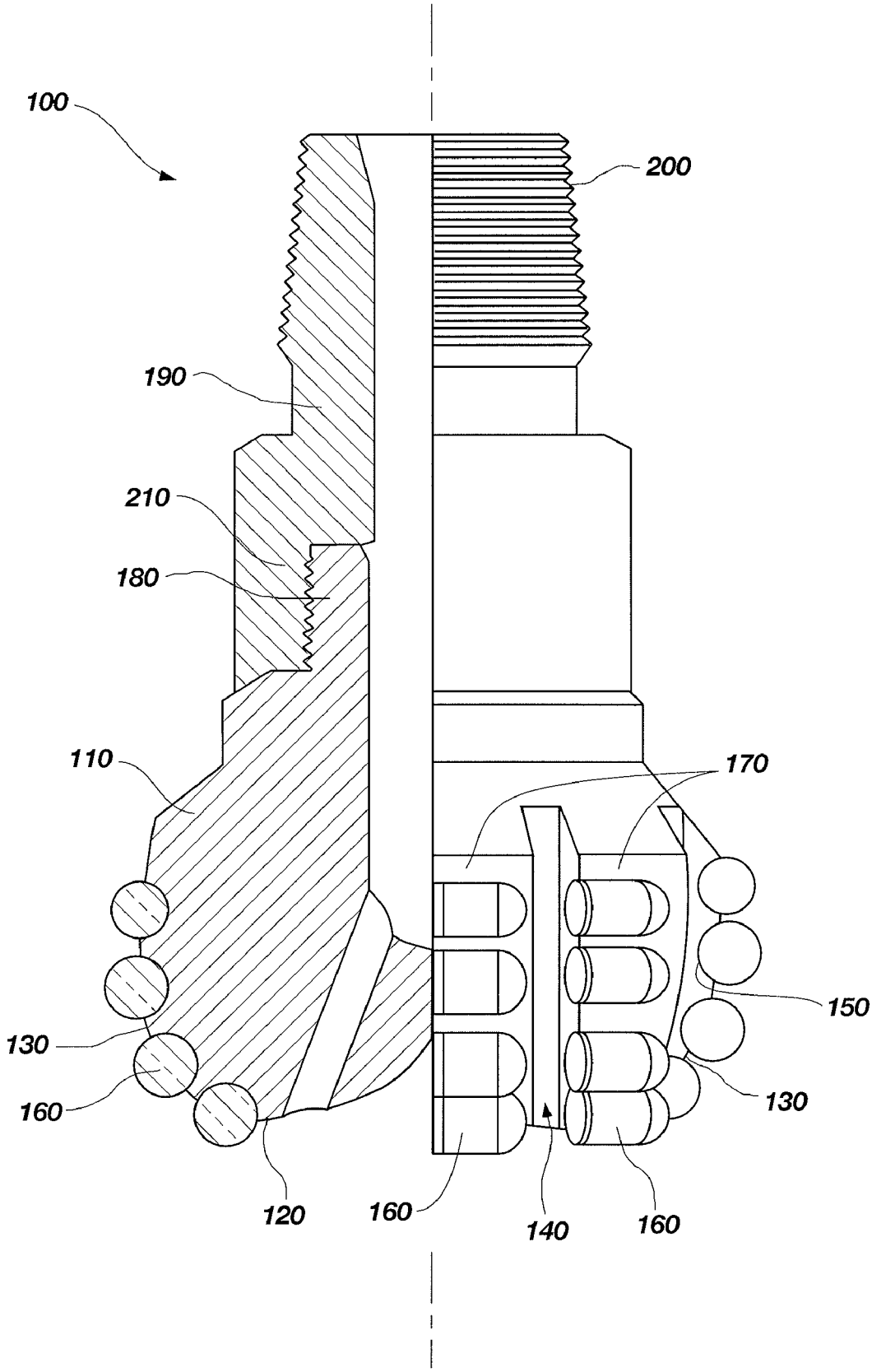
FIG. 1 illustrates an elevation view of a drill bit according to at least some embodiments of the present invention.

Various embodiments of the present invention are directed toward embodiments of earth-boring tools or drill bits comprising a bit body including threads configured to fixedly attach the bit body to a shank. FIG. 1 illustrates a drill bit 100 in the form of a fixed cutter or so-called "drag" bit, according to at least some embodiments of the present invention. As shown in FIG. 1, drill bit 100 includes a bit body 110 having a face 120 at a leading longitudinal end thereof and generally radially extending blades 130, forming fluid courses 140 therebetween. Bit body 110 may comprise a particle-matrix composite material, as well as a metal or metal alloy, such as steel, as are well known in the art.

Blades 130 may also include pockets 150, which may be configured to receive cutting elements 160, for instance, superabrasive cutting elements in the form of polycrystalline diamond compact (PDC) cutting elements. Generally, such a PDC cutting element may comprise a superabrasive region that is bonded to a substrate. Rotary drag bits employing PDC cutting elements have been employed for several decades.

PDC cutting elements are typically comprised of a disc-shaped diamond "table" formed on and bonded under a high-pressure and high-temperature (HPHT) process to a supporting substrate such as cemented tungsten carbide (WC), although other configurations are known. Drill bits carrying PDC cutting elements, which, for example, may be brazed into pockets in the bit face, pockets in blades extending from the face, or mounted to studs inserted into the bit body, are known in the art. It is also contemplated that cutting elements 160 may comprise, by way of example and not limitation, suitably mounted and exposed natural diamonds, thermally stable polycrystalline diamond compacts, cubic boron nitride compacts, or diamond grit-impregnated segments or integral portions of the bit body, as known in the art and as may be selected in consideration of the subterranean formation or formations to be drilled.

Each of blades 130 may also include a gage region 170 which is configured to define the outermost radius of the drill bit 100 and, thus the radius of the wall surface of a bore hole drilled thereby. Gage regions 170 comprise longitudinally upward (as the drill bit 100 is oriented during use) extensions of blades 130, extending from the face 120 and may have wear-resistant inserts or coatings, such as cutting elements in the form of gage trimmers of natural or synthetic diamond, hardfacing material, or sintered tungsten carbide on radially outer surfaces thereof as known in the art to inhibit excessive wear thereto.

The bit body 110 of drill bit 100 further includes a shank connector 180 at a trailing end thereof, longitudinally opposite from the face 120. The shank connector 180 comprises threads configured to be mated and at least substantially bound to a distal connector 210 of a shank 190. The shank 190 may comprise a proximal connector 200 at one longitudinal end thereof having an American Petroleum Institute (API) thread connection for attaching the shank 190 to a drill string (not shown). At an opposing longitudinal end of the shank 190 is a distal connector 210 comprising a set of threads configured to mate with the threads on the shank connector 180 of the bit body 110. Although the shank connector 180 is illustrated in FIG. 1 as being configured as a male connector and distal connector 210 as a female connector, such a configuration is not intended to be limiting. Instead, shank connector 180 may be configured as either a male or female connector with distal connector 210 of the shank 190 being properly configured to mate with the shank connector 180.

The threads for both the shank connector 180 and the distal connector 210 may comprise coarse and robust thread configurations. By way of example and not limitation, a suitable thread configuration may comprise a 3.500-12UN-2A thread. The thread combination between the shank connector 180 and the distal connector 210 may be configured to at least substantially bind with each other by galling or other mechanical interference, by introducing a particulate material on and between the threads, or both.

In some embodiments, the set of threads on the distal connector 210 and the threads on the shank connector 180 may be bound together by galling. By way of example and not limitation, such galling may be produced with threads on the shank connector 180 comprising a pitch that is at least slightly different from the pitch of the set of threads on the distal connector 210. In other embodiments, galling may be effected by providing at least one set of threads including a pitch which varies as the threads travel from the initial point of contact inward. In other words, the pitch of at least one set of threads (on shank connector 180 and/or distal connector 210) may at least slightly increase or decrease as the threads extend along the particular connector. By way of example and not limitation, the pitch of the shank connector 180 may be configured to at least slightly increase so that there is little or no binding when the shank connector 180 and distal connector 210 are initially coupled. However, as the shank connector 180 and distal connector 210 progress in being screwed together, the increase in the pitch of the shank connector 180 may result in galling between the two parts.

In other embodiments, the minor diameter, major diameter, or both of the male and female threads may be configured so that at least the minor diameter of one thread set is slightly too large for the correlating major diameter of the other thread set. In such a configuration, the minor diameter of the one thread set will at least slightly gall or interfere with the correlating major diameter of the other thread set, resulting in at least partial binding between the two thread sets.

In still other embodiments, the center of the male threads may be offset from the center of the female threads. In such embodiments, the male and female threads are non-concentric or not axially aligned. By way of example and not limitation, in some embodiments, the centers of the male and female threads may be offset a distance between about 0.005 inch (0.127 mm) and 0.100 inch (2.54 mm). In some non-limiting embodiments, the centers of the male and female threads may be offset a distance between about 0.010 inch (0.254 mm) and 0.020 inch (0.508 mm). Generally, a smaller offset may be more applicable for harder materials while a larger offset may be employed for softer, more malleable materials.

Those skilled in the art will recognize that there may be additional thread combinations between the shank connector 180 and the distal connector 210 forming an interference fit exhibiting the galling necessary to at least substantially retain or affix the shank connector 180 and distal connector 210 together.

In some embodiments, the set of threads on the distal connector 210 and the threads on the shank connector 180 may be bound together by disposing a particulate material comprising a plurality of hard particles between the threads of the shank connector 180 and the distal connector 210. The particulate material may be employed alone or in combination with threads configured to gall. By way of example and not limitation, the particulate material may comprise hard particles such as diamond grit, silicon carbide (SiC), alumina, and combinations thereof. Such hard particles may be sized and configured less than or equal to approximately 250 microns. In some embodiments, the plurality of hard particles may comprise hard ceramic particles sized between 5 and 50 microns.

Figure 2:
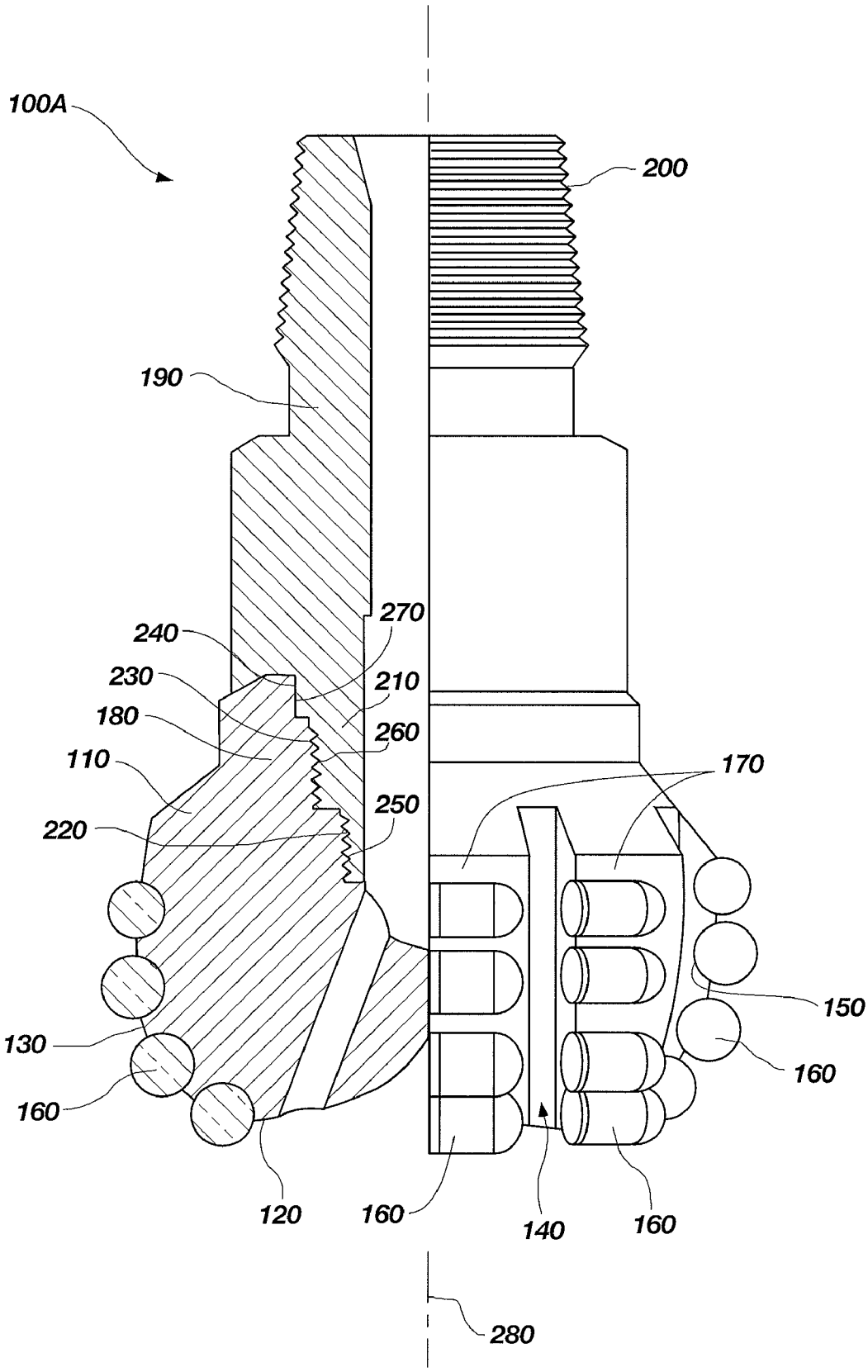
FIG. 2 illustrates an elevation view of a drill bit comprising a bit body comprising alignment structure according to some embodiments of the invention.

In some embodiments of the present invention, the male and female threads may comprise a portion configured to align the shank and the bit body and a portion to secure the shank and bit body. FIG. 2 illustrates an elevation view of a drill bit 100A comprising a bit body 110 comprising alignment structure according to some embodiments of the invention. The shank 190 comprises a distal connector 210 including a shank alignment portion and a shank locking portion, which may also be referred to, respectively, as shank alignment threads 220 and shank locking threads 230. The distal connector 210 may also include a shank alignment feature 240. The shank alignment threads 220 comprise any conventional threads used in conventional drill bits for aligning a shank and bit body prior to being secured together. The shank alignment feature 240 may comprise a stepped portion of the distal connector 210 and may comprise an outer diameter exhibiting a substantially tight tolerance.

The bit body 110 comprises a shank connector 180 including related alignment structure to correlate to the alignment structure of the distal connector 210. The shank connector 180 comprises a body alignment portion and a body locking portion, which may also be referred to herein as body alignment threads 250 and body locking threads 260, respectively. The shank connector 180 may also include a body alignment feature 270. The body alignment threads 250 are configured to correlate to the shank alignment threads 220 for aligning the shank 190 and the bit body 110. The body locking threads 260 are configured to correlate to and at least substantially bind together with the shank locking threads 230. In addition, the body alignment feature 270 is configured to receive the shank alignment feature 240, both features comprising a substantially tight tolerance so that the longitudinal axis 280 of the shank 190 and the bit body 110 are at least substantially aligned.

In at least some embodiments, the body locking threads 260 and the shank locking threads 230 may be configured to not bind initially. In such embodiments, the portions of the body locking threads 260 and the shank locking threads 230 which initially engage may be configured to not bind, similar to the body alignment threads 250 and the shank alignment threads 220. As the bit body 110 and shank 190 are screwed together, the body locking threads 260 and shank locking threads 230 may be configured to bind. The position in which the body locking threads 260 and shank locking threads 230 begin to bind may be configured so that the bit body 110 and shank 190 may mate at interface 300, or at least substantially mate in some embodiments employing one or more gaskets 290 (FIGS. 4-6), as described below. Thus, the binding of the body locking threads 260 and shank locking threads 230 may occur near the last or final rotations of the bit body 110 and the shank 190 as the two are screwed together.

Figure 3:
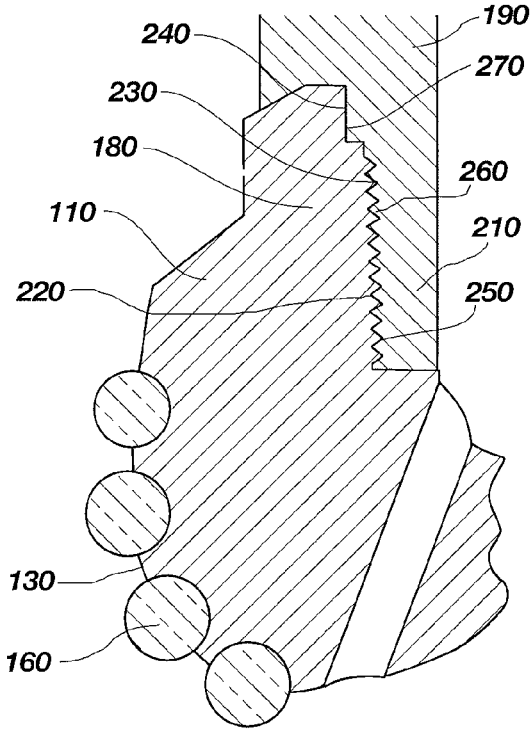
FIG. 3 is a partial cross sectional view of a drill bit comprising a bit body comprising a body alignment portion and a body locking portion, and a shank comprising a shank alignment portion and a shank locking portion.

As shown in FIG. 2, the body and shank alignment threads 250, 220, respectively, have a smaller diameter than the body and shank locking threads 260, 230, respectively. However, in other embodiments, as illustrated in FIG. 3, the respective body and shank alignment threads 250, 220 may comprise at least substantially the same diameter as the respective body and shank locking threads 260, 230. By way of example and not limitation, in some embodiments, the body alignment threads 250 and the body locking threads 260 may comprise the same thread configuration and may have substantially the same nominal diameter (inner diameter for a female configuration, outer diameter for a male configuration). The shank alignment threads 220 may be configured to mate with the body alignment threads 250 and the body locking threads 260 with minimal binding, much like conventional alignment threads. The shank locking threads 230, however, are configured to at least substantially bind with the body locking threads 260 as described above with reference to FIG. 1.

Thus, in the embodiment shown in FIG. 3, when the bit body 110 and the shank 190 are screwed together, the shank alignment threads 220 initially engage and mate with the body locking threads 260 with minimal to no binding. The shank alignment threads 220 continue through the body locking threads 260 and subsequently engage the body alignment threads 250 with minimal to no binding. The bit body 110 and the shank 190 may, therefore be properly aligned. About the same point or soon after the shank alignment threads 220 engage the body alignment threads 250, the shank locking threads 230 engage the body locking threads 260. As the shank locking threads 230 and the body locking threads 260 are screwed together, the shank locking threads 230 and the body locking threads 260 at least substantially bind together.

The location at which the shank locking threads 230 engage the body locking threads 260 may be configured to allow the bit body 110 and the shank 190 to be screwed together so as to contact at an interface 300, wherein such contact may include physically contacting each other or contacting one or more gaskets 290 (FIGS. 4-6) positioned at the interface 300. The force on the bit body 110 and shank 190 at the interface 300 may aid in loading the threads to prevent or at least reduce the chance of backing off of the connection.

Although the shank connector 180 is illustrated in FIGS. 2 and 3 as being configured as a female connector and distal connector 210 as a male connector, such a configuration is not intended to be limiting. Instead, shank connector 180 may be configured as either a male or female connector with distal connector 210 of the shank 190 being properly configured to receive the shank connector 180.

Figure 4:
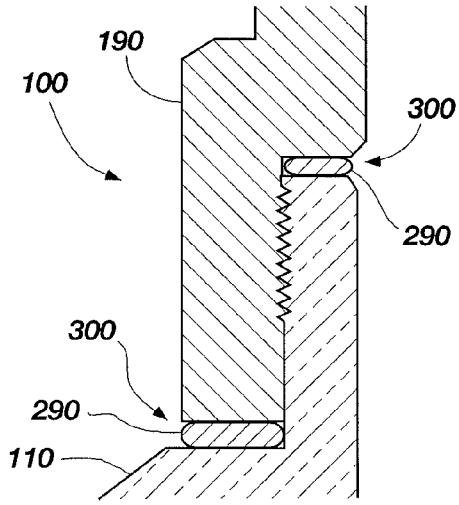
FIGS. 4-6 are partial cross sectional views illustrating various embodiments of drill bits comprising one or more gaskets according to some embodiments of the present invention.
Figure 5:
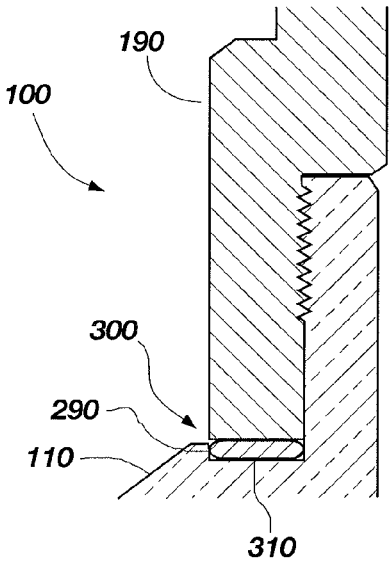
Figure 6:
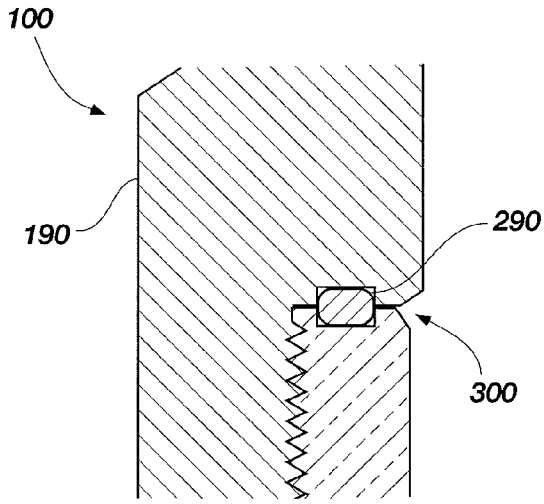

Additional embodiments of the present invention may include one or more gaskets 290 positioned and configured to seal at least a portion of the interface 300, also referred to herein as a "mating surface," between the bit body 110 and the shank 190 from drilling fluid and other materials. FIGS. 4-6 illustrate various embodiments of gasket configurations according to some embodiments of the present invention. In some embodiments, a gasket 290 may be positioned at the interface 300 located adjacent an exterior wall of the drill bit 100, at the interface 300 located adjacent an interior wall of the drill bit 100, or both. In some embodiments, the gasket 290 may be positioned in a grooved region, such as annular groove 310, positioned in an interface surface of the bit body 110 (see FIG. 5), an interface surface of the shank 190, or both (see FIG. 6).

In some embodiments, the gasket 290 may comprise a compliant material capable of deforming, such as rubber or nylon. In such embodiments, the gasket 290 may comprise a conventional O-ring positioned at the interface 300, including within the annular groove 310, when present. In other embodiments, the gasket 290 may comprise a metal material having a low melting point. By way of example and not limitation, the metal material may comprise a solder or other metal having a melting point below about 640° F. (about 338° C.).

Further embodiments of the present invention are directed to methods of forming earth-boring tools configured to fixedly attach the bit body 110 to the shank 190. Forming a drill bit 100, according to some embodiments, may comprise forming a shank 190 comprising a distal connector 210 having a set of threads thereon. A bit body 110 is formed comprising a face 120 and a shank connector 180. Threads may be formed on the shank connector 180 with at least a portion of the threads being configured to at least partially bind with at least a portion of the set of threads on the distal connector 210. The shank 190 may be affixed to the bit body 110 by screwing together the distal connector 210 of the shank 190 and the shank connector 180 of the bit body 110.

The shank 190 may be formed from a metal or metal alloy, such as steel. Some embodiments may further comprise forming a set of threads on the proximal connector 200 as well as the distal connector 210. The threads on the proximal connector 200 may be formed to comprise an API thread connection for attaching the shank 190 to a drill string. The threads on both the proximal connector 200 and the distal connector 210 may be formed according to conventional methods, including, but not limited to, machining, rolling, casting and grinding.

The bit body 110 may be formed of a material such as a metal or metal alloy, such as steel, or a particle-matrix composite material. The threads on the shank connector 180 of the bit body 110 may be formed by machining, rolling, casting, grinding, or any other conventional means. In embodiments where the bit body 110 is formed of a particle-matrix composite material, the bit body 110 may be formed by conventional infiltration methods (in which hard particles (e.g., tungsten carbide) are infiltrated by a molten liquid metal matrix material (e.g., a copper based alloy) within a refractory mold), as well as by newer methods generally involving pressing a powder mixture to form a green powder compact, and sintering the green powder compact to form a bit body 110. The green powder compact may be machined as necessary or desired, prior to sintering using conventional machining techniques like those used to form steel bodies or steel plate structures. Indeed, in some embodiments, the threads on the shank connector 180 may be formed with the bit body 110 in a green powder compact state, or in a partially sintered brown body state. Furthermore, additional machining processes may be performed after sintering the green powder compact to the partially sintered brown state, or after sintering the green powder compact to a desired final density.

In some embodiments, at least a portion of the threads on the shank connector 180 may be configured to at least partially bind by forming at least a portion of the threads to gall with at least a portion of the set of threads on the distal connector 210 of the shank 190. When the bit body 110 comprises a particle-matrix composite material, the threads on the shank connector 180 may be formed when the bit body 110 is in the green powder compact or the brown state. Subsequently, when the bit body 110 is sintered to the desired final density, the thread configuration may deflect or deform slightly to produce the desired interference to enable the set of threads on the shank connector 180 to gall with the set of threads on the distal connector 210.

In some embodiments, forming the bit body 110 with threads configured to at least partially bind with the set of threads on the distal connector 210 may comprise disposing a particulate material between the threads on the shank connector 180 and the set of threads on the distal connector 210. The particulate material may be disposed on the set of threads on the shank connector 180, the distal connector 210, or both prior to screwing them together. The particulate material may be disposed on threads configured to gall with each other as well as threads configured to be free from any substantial galling.

Some embodiments include disposing a gasket 290 at the interface 300 between the bit body 110 and the shank 190. In embodiments which comprise an annular groove 310, the gasket 290 may be disposed at least partially within the annular groove 310. In embodiments in which the gasket 290 comprises a compliant material, the gasket 290 may be depressed at least partially within the annular groove 310 and at least substantially locked into place.

In embodiments in which the gasket 290 comprises a metal having a low melting point, the material comprising the gasket 290 may be disposed in a molten or solid form on an interfacing surface and/or in a groove of the bit body 110, the shank 190, or both. The bit body 110 and shank 190 may be screwed together as described above and the assembly may be heated to a temperature greater than or equal to the melting point of the metal gasket material to reflow the metal gasket material. In other embodiments, the metal gasket material may be brazed at the interface 300.

Additional embodiments of the present invention relate to methods of securing a bit body of an earth-boring tool to a shank. In at least some embodiments, the method may include providing the bit body 110 comprising a shank connector 180. The shank connector 180 comprises threads formed at a trailing end thereof. A shank 190 comprising a distal connector 210 is provided with a set of threads on the distal connector. The shank connector 180 of the bit body 110 may be coupled to the distal connector 210 of the shank 190 by screwing the shank connector 180 and the distal connector 210 together.

While certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art. Thus, the scope of the invention is only limited by the literal language, and legal equivalents, of the claims which follow.

What is claimed is:

1. An earth-boring tool, comprising:

a shank comprising a proximal connector at one longitudinal end thereof and a distal connector at an opposing longitudinal end, the distal connector comprising at least one set of threads;

a bit body comprising a face at one longitudinal end thereof and a shank connector at an opposing longitudinal end, the shank connector comprising threads mated with the at least one set of threads on the distal connector; and wherein the at least one set of threads on the distal connector and the threads on the shank connector are at least substantially bound together with a particulate material disposed on and between the at least one set of threads on the distal thread connector and the threads on the shank connector.

2. The earth-boring tool of claim 1, wherein the particulate material comprises a plurality of hard particles.

3. The earth-boring tool of claim 2, wherein the plurality of hard particles comprises at least one material selected from the group consisting of diamond grit, SiC, and alumina.

4. The earth-boring tool of claim 2, wherein the plurality of hard particles are sized approximately 250 microns or less.

5. The earth-boring tool of claim 4, wherein the plurality of hard particles are sized approximately between 5 and 50 microns.

6. The earth-boring tool of claim 1, wherein:

the distal connector further comprises a shank alignment feature; and the shank connector further comprises a body alignment feature configured to receive the shank alignment feature so that a longitudinal axis of the shank and a longitudinal axis of the bit body are at least substantially aligned.

7. The earth-boring tool of claim 1, wherein the shank connector comprises male threads and the distal connector comprises female threads.

8. The earth-boring tool of claim 1, wherein the shank connector comprises female threads and the distal connector comprises male threads.

9. An earth-boring tool, comprising:

a shank comprising a proximal connector at one longitudinal end thereof and a distal connector at an opposing longitudinal end, the distal connector comprising at least one set of threads;

a bit body comprising a face at one longitudinal end thereof and a shank connector at an opposing longitudinal end, the shank connector comprising threads mated with the at least one set of threads on the distal connector; and wherein the at least one set of threads on the distal connector and the threads on the shank connector are at least substantially bound together by galling.

10. An earth-boring tool, comprising:

a shank comprising a proximal connector at one longitudinal end thereof and a distal connector at an opposing longitudinal end, the distal connector comprising at least one set of threads;

a bit body comprising a face at one longitudinal end thereof and a shank connector at an opposing longitudinal end, the shank connector comprising threads mated with the at least one set of threads on the distal connector; and wherein the at least one set of threads on the distal connector and the threads on the shank connector are at least substantially bound together and wherein at least one of the at least one set of threads on the distal connector and the threads on the shank connector comprise alignment threads and locking threads.

11. An earth-boring tool, comprising:

a shank comprising a proximal connector at one longitudinal end thereof and a distal connector at an opposing longitudinal end, the distal connector comprising at least one set of threads;

a bit body comprising a face at one longitudinal end thereof and a shank connector at an opposing longitudinal end, the shank connector comprising threads mated with the at least one set of threads on the distal connector; and a gasket positioned at an interface between the shank and the bit body, wherein the at least one set of threads on the distal connector and the threads on the shank connector are at least substantially bound together.

12. The earth-boring tool of claim 11, wherein the gasket is positioned in an annular groove positioned in at least one of the shank and the bit body.

13. The earth-boring tool of claim 11, wherein the gasket comprises rubber, nylon or a metal material.

14. The earth-boring tool of claim 13, wherein the gasket comprises a metal material having a melting point of about 640° F. or below.

15. An earth-boring drill bit, comprising:

a shank comprising a set of threads on a distal connector; and a bit body comprising a face at one longitudinal end thereof and a shank connector at an opposing longitudinal end, the shank connector comprising threads mated with the set of threads on the distal connector, the threads at least substantially binding the shank connector to the distal connector by galling.

16. The earth-boring drill bit of claim 15, further comprising a particulate material disposed on and between the set of threads on the distal thread connector and the threads on the shank connector.

17. The earth-boring drill bit of claim 15, wherein at least a portion of the set of threads on the distal connector comprises a thread pitch which differs from a thread pitch for at least a portion of the threads on the shank connector.

18. The earth-boring drill bit of claim 15, wherein at least a portion of the set of threads on the distal connector comprises at least one of a minor diameter and a major diameter which differs from at least one of a correlating minor diameter and a correlating major diameter for at least a portion of the threads on the shank connector.

19. The earth-boring drill bit of claim 15, wherein a center of at least a portion of the set of threads on the distal connector is offset from a center of at least a portion of the threads on the shank connector.

20. The earth-boring drill bit of claim 19, wherein the center of the at least a portion of the set of threads on the distal connector is offset a distance between 0.005 inch and 0.100 inch.

21. The earth-boring drill bit of claim 20, wherein the center of the at least a portion of the set of threads on the distal connector is offset a distance between 0.010 inch and 0.020 inch.

22. The earth-boring drill bit of claim 15, wherein:

the set of threads on the distal connector comprise a shank alignment portion and a shank locking portion; and the threads on the shank connector comprise a body alignment portion and a body locking portion.

23. The earth-boring drill bit of claim 22, wherein the distal connector comprises an at least substantially constant diameter, and wherein the shank connector comprises an at least substantially constant diameter.

24. The earth-boring drill bit of claim 15, further comprising a shank alignment feature on the distal connector configured to receive a body alignment feature on the shank connector to at least substantially align a respective longitudinal axis of the shank and the bit body.

25. The earth-boring drill bit of claim 15, further comprising at least one gasket positioned at an interface between the shank and the bit body.

26. A method of forming an earth-boring tool, comprising:

forming a shank comprising a distal connector including a set of threads thereon;

forming a bit body comprising a shank connector with threads thereon, at least a portion of the threads configured to at least partially bind with the set of threads on the distal connector; and screwing together the distal connector of the shank and the shank connector of the bit body and at least partially binding the threads of the shank connector with the set of threads on the distal connector.

27. The method of claim 26, wherein forming the bit body comprises:

providing a powder mixture;

pressing the powder mixture to form a green bit body; and at least partially sintering the green bit body.

28. The method of claim 26, further comprising sealing an interface between the shank and the bit body.

29. The method of claim 28, wherein sealing the interface between the shank and the bit body comprises disposing a gasket at the interface.

30. The method of claim 29, wherein disposing a gasket comprises disposing a gasket comprising a rubber, plastic, or metal material.

31. The method of claim 30, wherein the gasket comprises a metal material, and further comprising heating the bit body and the shank to a temperature greater than or equal to a melting temperature of the metal material.

32. The method of claim 29, wherein disposing the gasket at the interface comprises:

forming a groove in an interface surface of at least one of the shank and the bit body; and disposing the gasket at least partially within the groove.

33. The method of claim 26, further comprising disposing a particulate material on at least one of the distal connector and the shank connector prior to screwing together the distal connector of the shank and the shank connector of the bit body.

34. A method of forming an earth-boring tool, comprising:

forming a set of threads on a distal connector of a shank;

forming threads on a shank connector of a bit body configured to at least partially bind with the set of threads formed on the distal connector;

coupling the set of threads on the distal connector to the threads on the shank connector and at least partially binding the threads on the shank connector with the set of threads formed on the distal connector.

35. The method of claim 34, wherein forming threads on the shank connector of the bit body configured to at least partially bind with the set of threads formed on the distal connector comprises forming at least a portion of the threads on the shank connector to comprise a thread pitch which differs from a thread pitch for at least a portion of the set of threads on the distal connector.

36. The method of claim 34, wherein forming threads on a shank connector of a bit body configured to at least partially bind with the set of threads formed on the distal connector comprises forming at least a portion of the threads on the shank connector to comprise at least one of a minor diameter and a major diameter which differs from at least one of a correlating minor diameter and a correlating major diameter for at least a portion of the set of threads on the distal connector.

37. The method of claim 34, wherein forming threads on the shank connector of the bit body configured to at least partially bind with the set of threads formed on the distal connector comprises forming at least a portion of the threads on the shank connector to comprise a center offset from a center of at least a portion of the set of threads on the distal connector.

38. The method of claim 34, wherein forming threads on the shank connector of the bit body comprises forming threads on the shank connector in a green bit body.

39. The method of claim 38, wherein forming the threads on the shank connector of the bit body configured to at least partially bind with the set of threads formed on the distal connector comprises sintering the bit body to a final density, and at least slightly deforming the threads on the shank connector during the sintering.

40. The method of claim 34, wherein:

forming the set of threads on the distal connector of the shank comprises forming a shank alignment portion and a shank locking portion; and forming threads on the shank connector of the bit body comprises forming a body alignment portion and a body locking portion.

41. The method of claim 40, wherein the distal connector comprises an at least substantially constant diameter, and wherein the shank connector comprises an at least substantially constant diameter.

42. The method of claim 34, further comprising disposing a particulate material on at least one of the distal connector and the shank connector prior to screwing together the distal connector of the shank and the shank connector of the bit body.

43. A method of securing a bit body of an earth-boring tool to a shank, the method consisting essentially of:

providing a bit body comprising a shank connector at a trailing end thereof, the shank connector comprising threads thereon;

providing a shank configured to attach to a drill string and comprising a distal connector at a leading end thereof, the distal connector comprising a set of threads thereon; and screwing the shank connector of the bit body to the distal connector of the shank.

* * * * *